US005887301A

United States Patent [19]

Anderson

[11] Patent Number: 5,887,301

[45] Date of Patent: Mar. 30, 1999

[54] CONVERTIBLE BLANKET AND CARRIER

[76] Inventor: Brenda Anderson, 457 Hidden Valley Rd. N., Florence, Mont. 59833

[21] Appl. No.: 103,659

[22] Filed: Jun. 23, 1998

[51] Int. Cl.[6] ..... A47G 9/02

[52] U.S. Cl. ..... 5/482; 383/4; 383/40; 190/107; 5/420; 5/485

[58] Field of Search ..... 5/417, 420, 482, 5/485, 646, 922, 923; 190/107, 115; 383/4, 6, 39, 40, 84

[56] References Cited

U.S. PATENT DOCUMENTS

| | | | |
|---|---|---|---|
| 2,315,126 | 3/1943 | Michalke | 190/43 |
| 2,451,142 | 10/1948 | Zimmern | 224/8 |
| 2,557,280 | 6/1951 | Hahn | 383/40 X |
| 2,626,648 | 1/1953 | Anderson | 150/12 |
| 2,659,404 | 11/1953 | Kelsey | 150/1 |
| 2,783,473 | 3/1957 | Humpeler | 2/69 |
| 4,097,944 | 7/1978 | Yulish | 5/344 |
| 4,188,988 | 2/1980 | Agyagos | 150/1.7 |
| 4,197,891 | 4/1980 | Comollo | 150/12 |
| 4,223,056 | 9/1980 | Di Fronzo | 428/52 |
| 4,468,810 | 8/1984 | Longo | 383/3 |
| 4,600,091 | 7/1986 | McLeod | 190/2 |
| 4,671,393 | 6/1987 | Rainey | 5/420 X |
| 4,886,150 | 12/1989 | Fitzsimmons | 190/1 |
| 4,917,505 | 4/1990 | Bullard et al. | 383/4 |
| 4,991,245 | 2/1991 | Franco | 5/419 |
| 5,002,401 | 3/1991 | Blackman | 383/39 X |
| 5,346,308 | 9/1994 | Buhot et al. | 383/4 |
| 5,370,460 | 12/1994 | Nelson | 5/417 X |
| 5,481,767 | 1/1996 | Lewis | 5/417 |

FOREIGN PATENT DOCUMENTS

| | | |
|---|---|---|
| 77288 | 8/1950 | Norway . |

*Primary Examiner*—Kenneth J. Dorner
*Assistant Examiner*—Rodrigo J. Morales
*Attorney, Agent, or Firm*—Dowrey & Associates

[57] ABSTRACT

A convertible blanket and carrier having a rectangular main section and a pocket applied to one side of the main section along one end. A pair of handles are attached to one side of the main section and a blanket fastener is attached to the end opposite the pocket end for securing the carrier formed by double folding the main section.

11 Claims, 3 Drawing Sheets

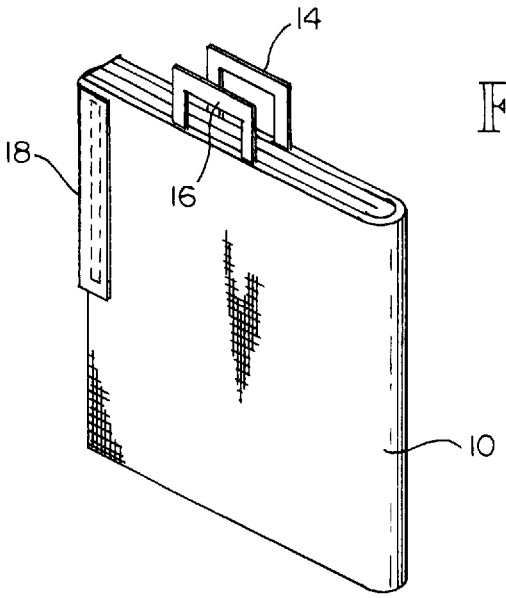
FIG. 4
FIG. 5
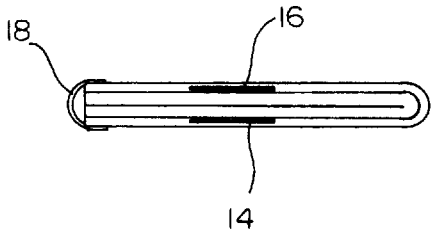

CONVERTIBLE BLANKET AND CARRIER

BACKGROUND OF THE INVENTION

1. Field of the Invention

This invention relates to baby blankets and, more particularly, to baby blankets that can be converted to carrying bags.

2. Description of the Prior Art

The prior art contains many examples of mats, blankets and towels which are designed for flat use and convertible to portable carriers. One example of such articles is disclosed in the Nelson U.S. Pat. No. 5,370,460 which utilizes a system of six strategically located handles to transform a rectangular mat into a totable bag. Other configurations have been proposed which lend themselves to infant care including mats for diaper changing convertible to infant carriers and/or feeding and changing accessories. These devices are usually rather expensive because of the need for special materials and fabrics and complex panel configurations. Examples of this type of device may be found in U.S. Pat. No. 4,886,150 to Fitzsimmons and U.S. Pat. No. 4,917,505 to Bullard et al. The present invention seeks to reduce the complexity of and reduce the cost of such devices without sacrificing the utility of the article.

SUMMARY OF THE INVENTION

A primary object of the convertible blanket of this invention is to provide a blanket that can be easily folded and unfolded and that can be carried in its folded condition. Another object is to provide such a blanket that has integral carrying handles. A further object is to provide such a blanket that can be folded up for carrying and secured in its folded condition without the need for zippers, snaps or straps.

These objects and advantages will become apparent from the following description of the invention.

In accordance with these objects and advantages, the blanket of this invention comprises a rectangular main section, a pocket applied to one side of the blanket section along one end of the blanket, a pair of handles attached to one side of the blanket, and a blanket fastener attached to the opposite end of the blanket.

BRIEF DESCRIPTION OF THE DRAWINGS

FIG. 4 is a perspective view of the FIG. 1 blanket with the second fold of FIG. 3 completed resulting in the completion of the process of converting the blanket to a carrying bag; and FIG. 5 is a top plan view of the folded bag.

DESCRIPTION OF THE PREFERRED EMBODIMENT

Figure 1:
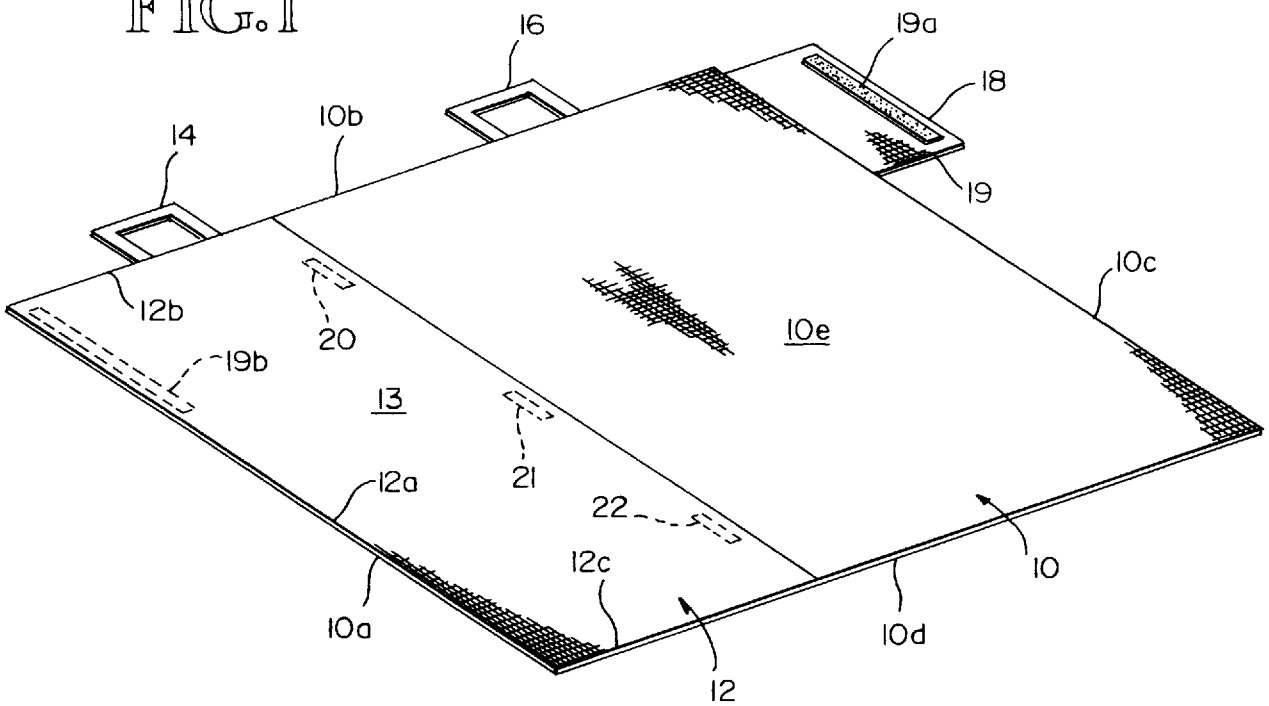
FIG. 1 is a perspective view of the blanket of this invention.

The baby blanket of this invention is designed to provide a play area blanket for a baby. It is also designed to provide for storage of a baby's play articles. Furthermore, the blanket is designed to be folded into a carryable condition in such a manner that stored articles can be securely carried in the folded blanket. The blanket comprises a rectangular main section 10, a pocket 12 applied along one end 10*a* of the blanket section 10, a pair of handles 14, 16 attached to one side 10*b* of the blanket, and a blanket fastener 18 attached to the opposite end 10*c* of the blanket.

It is important to the utility of the blanket that the pocket 12 be arranged along one end 10*a* of the blanket and that the handles 14, 16 be arranged along one of the sides 10*b* of the blanket so that the handles are aligned perpendicular to the alignment of the pocket 12. The pocket 12 may be provided by a rectangular section 13 that is applied across the width of the blanket section 10, so that it can be stitched, or otherwise attached, to the blanket section 10 along the adjacent end 10*a*, side 10*b* and the opposite side 10*d*. In the orientation shown in FIG. 1, the pocket 12 opens toward the opposite end 10*c* and is closed on three sides, 12*a*, 12*b* and 12*c*. The pocket provides a storage compartment for various articles that is closed on three sides and that opens toward the opposite end 10*c*. Preferably the pocket compartment is provided between the pocket section 13 and the opposing face 10*e* of the blanket section. The depth of the pocket 12 is preferably less than ½ the length of the blanket section 10 for a purpose to be described.

The pocket compartment opening may be compartmentalized by closures 20, 21 and 22, in the preferred form of VELCRO hook and loop strips applied to the inner side of the pocket section 13 and the opposed face 10*e* of the blanket section 10 in face-to-face opposition so that the pocket compartment may be selectively opened and closed along its length. These closures 20, 21, and 22 may be placed along the edge of the pocket opening as shown in FIG. 1. If desired, the pocket 12 could be formed as a separate unit, having its own pocket compartment, and that unit could be fastened across the width of the blanket section 10 so as to appear as seen in FIG. 1. If the pocket 12 is formed as a separate unit, the closures 20, 21 and 22 would be attached in face-to-face opposition within the pocket unit.

Figures 2, 3:
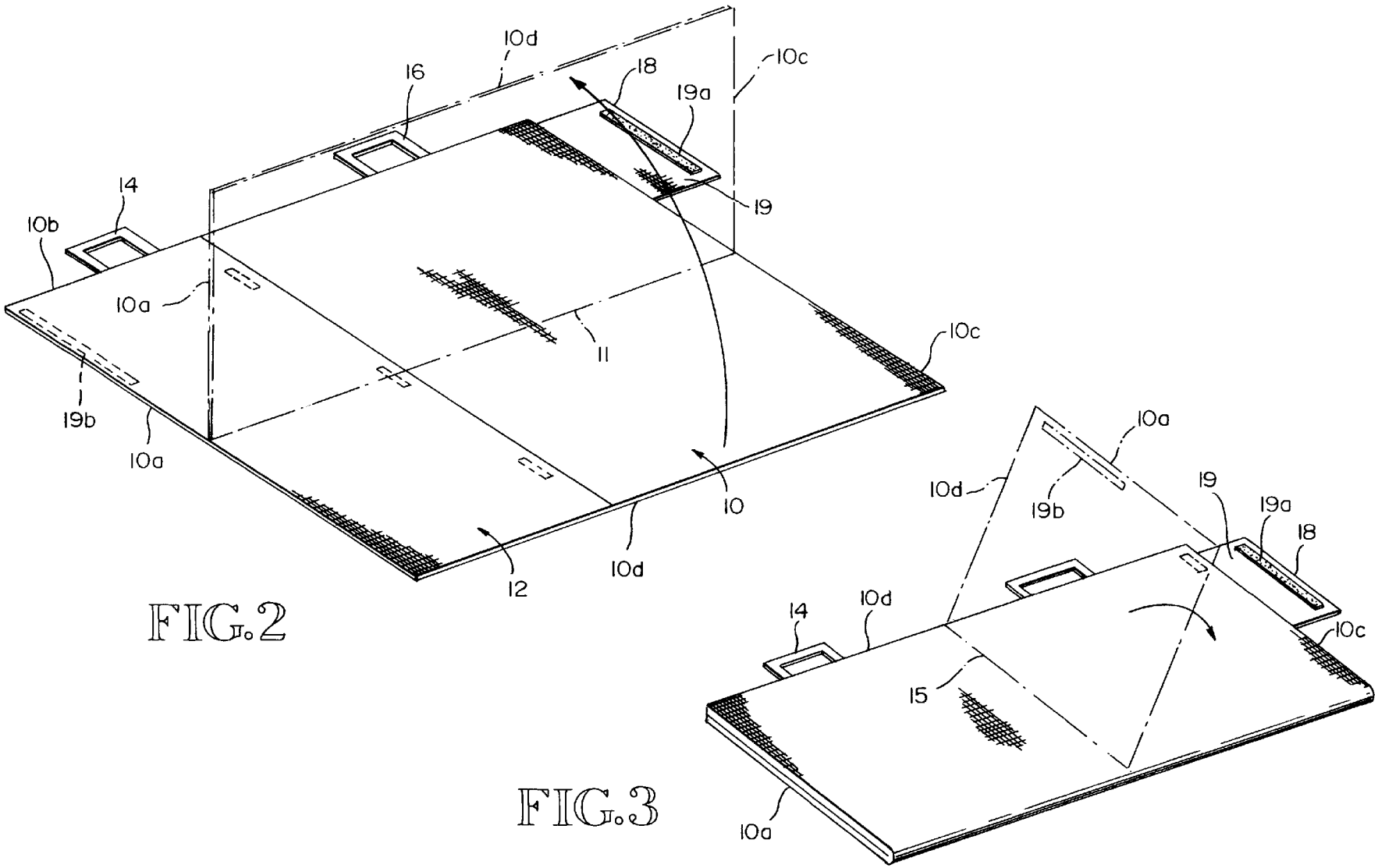
FIG. 2 is a perspective view of the FIG. 1 blanket illustrating in dashed lines a first fold in the process of converting the blanket to a carrying bag.
FIG. 3 is a perspective view of the FIG. 1 blanket with the first fold of FIG. 2 completed and, a second fold illustrated in dashed lines, in the process of converting the blanket to a carrying bag.

As seen in sequence in FIGS. 2–4, the blanket may be folded into a carryable condition in the following sequence of steps. First, the blanket section 10 is folded lengthwise along its longitudinal axis 11 as seen in FIGS. 2 and 3. This lengthwise folding folds the blanket section 10 in half, bringing the opposite side 10*d* into superimposition with side lob. This folding step doubles the pocket 12 back onto itself. Secondly, the blanket section 10 is folded cross-wise along its transverse axis 15 as seen in FIG. 3. This cross-wise folding folds the blanket section 10 into quarters, bringing the end 10*a* into superimposition with the opposite end 10*c*. The depth of the pocket 12 should be less than ½ the length of the blanket section 10 so that the second folding step of FIG. 3 will place the pocket compartment completely on one side of the transverse fold line. By locating the pocket compartment completely in one half of the blanket section, the second folding action of FIG. 3 cannot result in some of the pocket's contents being forced out of the pocket during the folding process. In order to reduce further the chance that some of the pocket's contents might be dislodged from the pocket during the second folding step of FIG. 3, it would be appropriate to fold the opposite end 10*c* up and across so as to overlay end 10*c* onto end 10*a*, the reverse of the step illustrated in FIG. 3.

The handles 14 and 16 are fastened to the blanket section side 10*b* at locations such that they will be overlaid when the second folding step of FIG. 3 is performed so that they are superimposed as seen in FIG. 4. This will place each handle center at ¼ of the length of the blanket section 10 in from the adjacent end. The blanket fastener 18 is located on opposite end 10*c* adjacent the side 10*b* so that the folded blanket of FIG. 4 can be secured in that condition by the fastener. A preferred form of the fastener 18 comprises a flap extension 19 on which a VELCRO hook or loop strip 19*a* is provided for attachment to a corresponding keeper in the form of a VELCRO loop or hook strip 19*b* appropriately located at the blanket section end 10*a*. VELCRO strip 19*a* is located to be wrapped over the folded blanket section and VELCRO strip 19*b* is located to be exposed to receive the VELCRO strip 19*a* as shown in FIG. 4. As seen in FIG. 1, VELCRO strip 19*a* is facing upward and VELCRO strip 19*b* is facing downward.

The dimensions of the blanket can be selected to suit the particular application of use for the blanket. In the foregoing description, regardless of the actual dimensions of the blanket, the "length" of the blanket is defined as extending between ends 10*a* and 10*c*, the "width" of the blanket is defined as extending between the sides 10*b* and 10*d*, and, hence, the longitudinal extent of the blanket is from end-to-end and the transverse extent of the blanket is from side-to-side. A preferred set of dimensions are as follows: length—48 inches; width 43 inches; handles—6 inches long and 3 inches high; fastener flap 12 inches wide and 6 inches long; pocket—18 inches deep and 43 inches wide.

The blanket parts of the blanket can be fabricated from a variety of materials, depending on the intended use of the completed blanket. For a baby blanket a soft quilted fabric would be suitable, both for the blanket section 12 and for the pocket section 13. The handles may be fabricated from any suitable material that can bear the weight of the blanket and contents stored in the pocket compartment.

While the preferred embodiment of the invention has been described herein, variations in the design may be made. For example, although the blanket has been described in respect of its preferred application as a baby blanket, it can just as easily be provided as a pet blanket and provided to store and carry pet articles such as pet playthings or pet grooming articles.

What is claimed is:

1. A convertible blanket and carrier device comprising in combination;

a rectangular sheet of foldable material having a central longitudinal axis and a central transverse axis defining opposite end and side edges respectively, the length of said sheet being defined as the distance between said opposite end edges, pocket forming means located along one of said end edges and including an access opening facing the opposite end edge, first and second spaced carrying handles attached to one of said side edges defining the top side edge of said sheet material, a fastener element attached to the opposite said end edge and a keeper element attached to said one end edge, whereby;

said sheet material may be folded in half along said longitudinal axis forming a first fold so as to double the pocket means back upon itself and to place said opposite sides in alignment, and said first fold may be folded in half along said transverse axis forming a second fold to divide said sheet material into quarter sections with said handles overlying each other to form a carrier, said fastener element being wrapped around the folded and superimposed end edges and connected to said keeper element to hold the carrier in the folded condition.

2. The blanket and carrier device of claim 1 wherein;

said pocket means extends from said one end a width less than one half the length of said sheet.

3. The blanket and carrier device of claim 2 wherein said pocket means extends the full distance between said opposite sides and is anchored to said one end and portions of each side edge.

4. The blanket and carrier device of claim 3 wherein said pocket means includes closure elements along the access opening to compartmentalize the pocket.

5. The blanket and carrier device of claim 4 wherein said pocket forming means comprises a single panel anchored to said sheet material about three sides thereof, said closure elements acting between one surface of the panel and the surface of said sheet.

6. The blanket and carrier device of claim 4 wherein said pocket forming means comprises a self contained double paneled structure anchored to said sheet material about three sides thereof, said closure elements acting between the panels thereof.

7. The blanket and carrier device of claim 1 wherein said first and second handles are located a distance of one fourth the length of the sheet from the respective end edges of the blanket, whereby said handles will be aligned upon completion of said second fold.

8. The blanket and carrier device of claim 1 wherein;

said fastener element is anchored to said opposite end edge adjacent said top side edge and extends a portion of the length of said opposite edge, said keeper element being connected to said one edge on the surface of said sheet material opposite from said pocket means, whereby said fastener element may be wrapped around the folded and superimposed end edges and connected to the keeper element on the side of the sheet material opposite the pocket forming means.

9. The blanket and carrier device of claim 4 wherein;

the length of said sheet along the longitudinal axis is 48 inches, the width of said sheet along the transverse axis is 43 inches, and said pocket is 18 inches deep and 43 inches wide.

10. A convertible blanket and carrier device comprising in combination;

a rectangular sheet of foldable material having a central longitudinal axis and a central transverse axis defining opposite end and side edges respectively, the length of said sheet being defined as the distance between said opposite end edges, a pocket panel having a width less than the length of said sheet along the longitudinal axis, extending the full distance between said opposite side edges and anchored thereto and to one end edge, said panel forming a pocket with an opening facing the opposite end edge, at least one closure element acting between one surface of said panel and the surface of said sheet to compartmentalize the pocket, first and second spaced carrying handles attached to one of said side edges defining the top side edge of said sheet said handles being located a distance of one fourth the length of the sheet material from the respective end edges, a fastener element anchored to said opposite end edge adjacent said top side edge and extending a portion of the length of said opposite edge, a keeper element attached adjacent to said one edge of the sheet on the surface thereof opposite from said pocket means, whereby;

said sheet material may be folded in half along said longitudinal axis forming a first fold so as to double the pocket panel back upon itself and to place said opposite side edges in alignment, and said first fold may be folded in half along said transverse axis forming a second fold to divide said sheet material into quarter sections with said handles overlying each other to form a carrier, said fastener element being wrapped around the folded and superimposed end edges and connected to said keeper element to hold the carrier in the folded condition.

11. A convertible blanket and carrier device comprising in combination;

a sheet of foldable material having a central longitudinal axis and a central transverse axis defining opposite end and side edges respectively, the length of said sheet being defined as the distance between said opposite end edges, pocket forming means located along one of said end edges and including an access opening facing the opposite end edge, carrying handles attached to one of said side edges defining the top side edge of said sheet material, fastener and keeper elements attached to said opposite end edges, whereby;

said sheet material may be folded in half along said longitudinal axis forming a first fold so as to double the pocket means back upon itself and to place said opposite sides in alignment, and said first fold may be folded in half along said transverse axis forming a second fold to divide said sheet material into quarter sections with said handles overlying each other to form a carrier, said fastener and keeper elements being wrapped around the folded and superimposed end edges to hold the carrier in the folded condition.

* * * * *